US007146826B1

(12) United States Patent
Schlosser

(10) Patent No.: US 7,146,826 B1
(45) Date of Patent: Dec. 12, 2006

(54) BEVERAGE COOLING APPARATUS

(76) Inventor: Douglas C. Schlosser, 8815 Yankee St., Dayton, OH (US) 45458

( * ) Notice: Subject to any disclaimer, the term of this patent is extended or adjusted under 35 U.S.C. 154(b) by 198 days.

(21) Appl. No.: 11/005,361

(22) Filed: Dec. 6, 2004

(51) Int. Cl.
*F17C 13/00* (2006.01)

(52) U.S. Cl. ..... 62/457.9

(58) Field of Classification Search ..... 62/371, 62/394, 395, 457.1–457.9
See application file for complete search history.

(56) References Cited

U.S. PATENT DOCUMENTS 3,302,428 A * 2/1967 Stoner et al. ..... 62/457.4
3,314,242 A 4/1967 Lofferts
4,299,100 A 11/1981 Crisman et al.
4,825,665 A * 5/1989 Micallef ..... 62/372
4,889,302 A * 12/1989 Tucker ..... 248/146
5,042,258 A * 8/1991 Sundhar ..... 62/3.2
5,283,420 A * 2/1994 Montalto ..... 219/432
D360,806 S 8/1995 Morris et al.
5,842,353 A 12/1998 Kuo-Liang
6,032,481 A 3/2000 Mosby
6,121,585 A * 9/2000 Dam ..... 219/438
6,141,969 A * 11/2000 Launchbury et al. ..... 62/3.2
6,269,653 B1 * 8/2001 Katusa ..... 62/457.9
6,422,024 B1 * 7/2002 Foye ..... 62/3.2
6,530,232 B1 3/2003 Kitchens
6,591,615 B1 * 7/2003 Luo ..... 62/3.7
6,634,417 B1 * 10/2003 Kolowich ..... 165/10
6,674,052 B1 * 1/2004 Luo ..... 219/520
6,758,363 B1 * 7/2004 Stokes ..... 220/592.15

FOREIGN PATENT DOCUMENTS

JP 9-81851 A * 3/1997

* cited by examiner

*Primary Examiner*—Mohammad M. Ali

(57) ABSTRACT

A beverage cooling apparatus includes a housing that has a bottom wall, a top wall and a peripheral wall. An opening extends through the peripheral wall. A cylindrical wall that is attached to and extends upwardly from the top wall forms a container. A cooling assembly is mounted in the housing and extends into the cylindrical wall. A power supply is electrically coupled to the coolant assembly. A pressure switch is electrically coupled to the power supply. The pressure switch is mounted in the bottom wall and extends downwardly away therefrom. The pressure switch is adapted for detecting a weight greater than 2 ounces. The pressure switch turns off the cooling assembly when a weight of less than 2 ounces is positioned on the top wall. The cooling assembly cools the cylindrical wall. The cylindrical wall cools a beverage can removably positioned within the container.

11 Claims, 7 Drawing Sheets

BEVERAGE COOLING APPARATUS

BACKGROUND OF THE INVENTION

1. Field of the Invention

The present invention relates to beverage cooling devices and more particularly pertains to a new beverage cooling device for cooling, and retaining a cold temperature of, individual beverages and in particular beverage cans.

2. Description of the Prior Art

The use of beverage cooling devices is known in the prior art. U.S. Pat. No. 6,032,481 describes a container that is adapted for keeping a fluid a constant temperature. Another type of beverage cooling device is U.S. Pat. No. 5,842,353 having a container which can be used for holding a fluid. The container is positionable on a base that heats or cools elements positioned within the container so that the fluid is heated or cooled. Yet another beverage cooling device is found in U.S. Pat. No. 6,530,232 which includes a sleeve that may be used for holding a beverage container. The sleeve maybe cooled so that the beverage container is also cooled.

While these devices fulfill their respective, particular objectives and requirements, the need remains for a device that is adapted for receiving a beverage can and either cooling the beverage can or retaining the beverage can at a particular temperature.

SUMMARY OF THE INVENTION

The present invention meets the needs presented above by generally comprising a housing that has a bottom wall, a top wall and a peripheral wall, which is attached to and extends between the top and bottom walls. An opening extends through the peripheral wall. A cylindrical wall that is attached to and extends upwardly from the top wall forms a container. A cooling assembly is mounted in the housing and extends into the cylindrical wall. A power supply is electrically coupled to the coolant assembly. A pressure switch is electrically coupled to the power supply. The pressure switch is mounted in the bottom wall and extends downwardly away therefrom. The pressure switch is adapted for detecting a weight greater than 2 ounces. The pressure switch turns off the cooling assembly when a weight of less than 2 ounces is positioned on the top wall. The cooling assembly cools the cylindrical wall. The cylindrical wall cools a beverage can removably positioned within the container.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
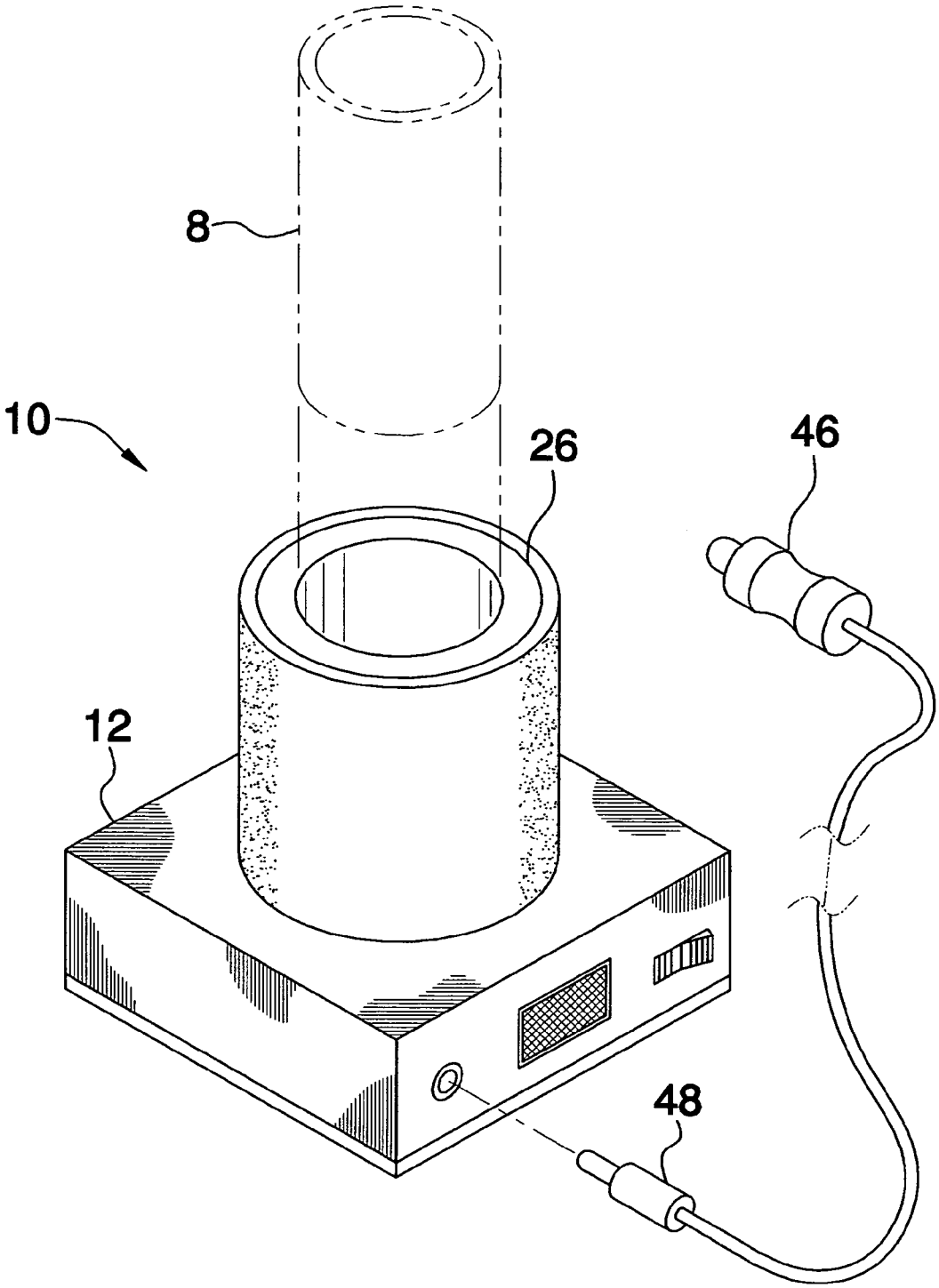
FIG. 1 is a perspective view of a beverage cooling apparatus according to the present invention.
Figure 2:
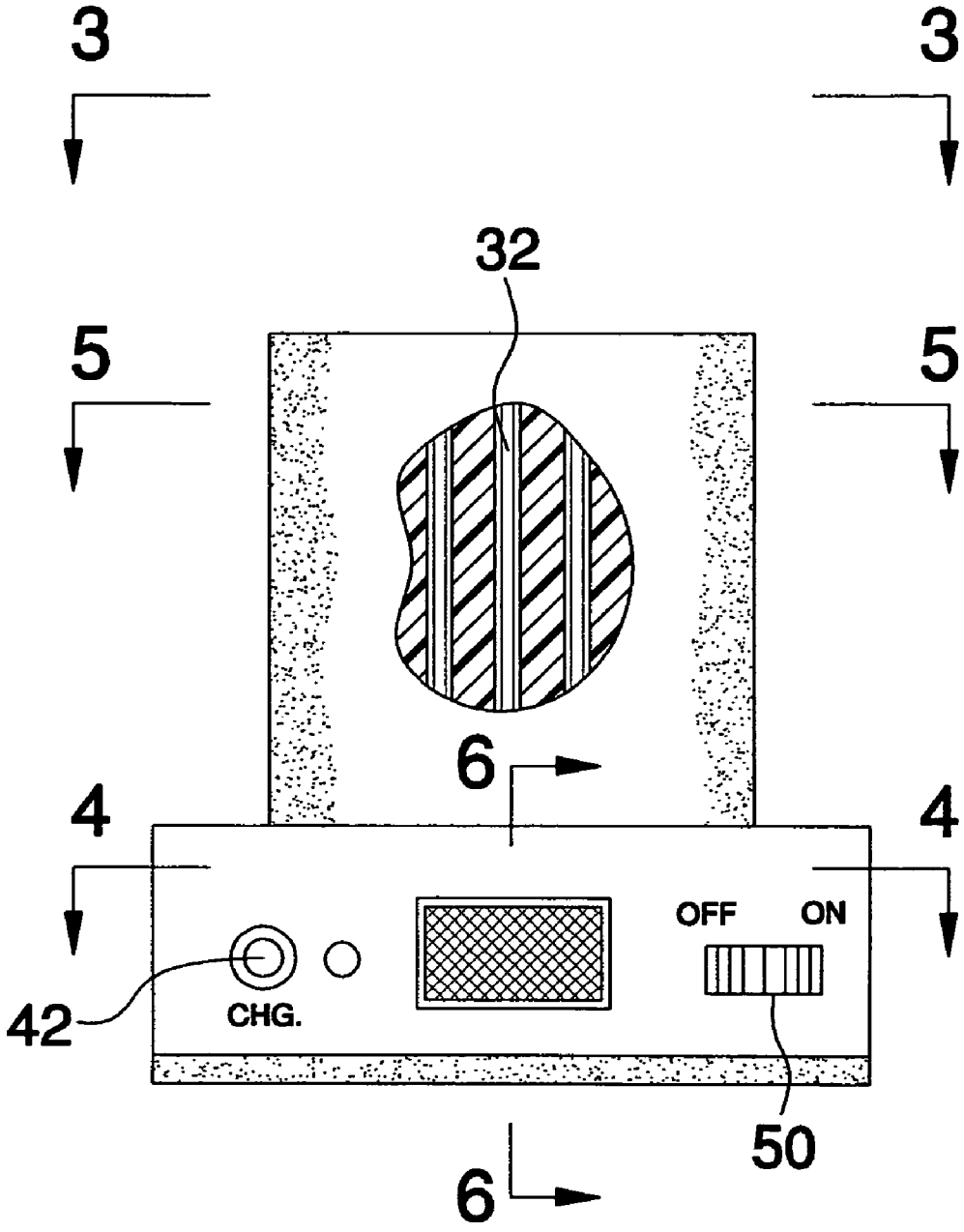
FIG. 2 is a front broken view of the present invention.
Figure 3:
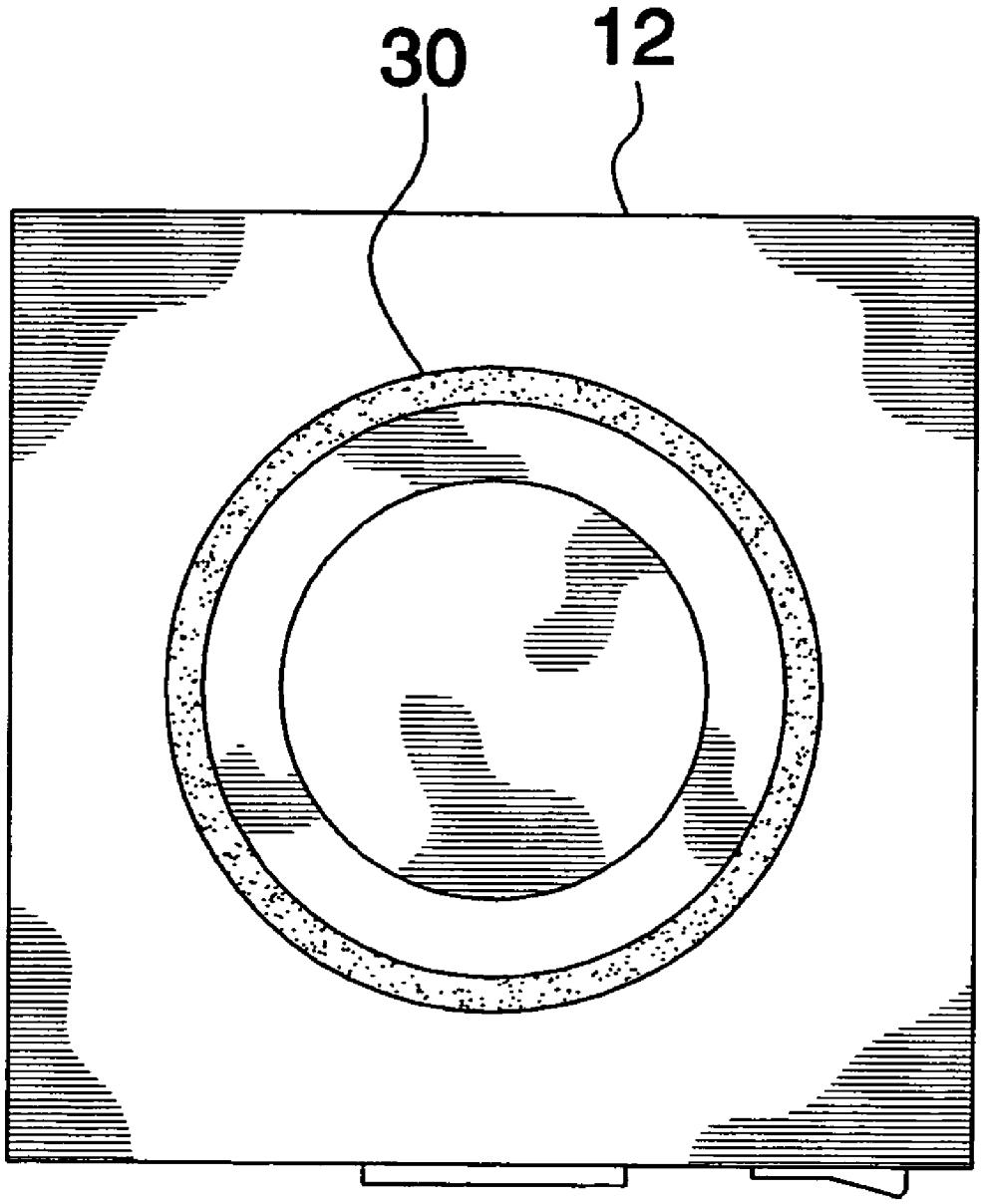
FIG. 3 is a top view of the present invention.
Figure 4:
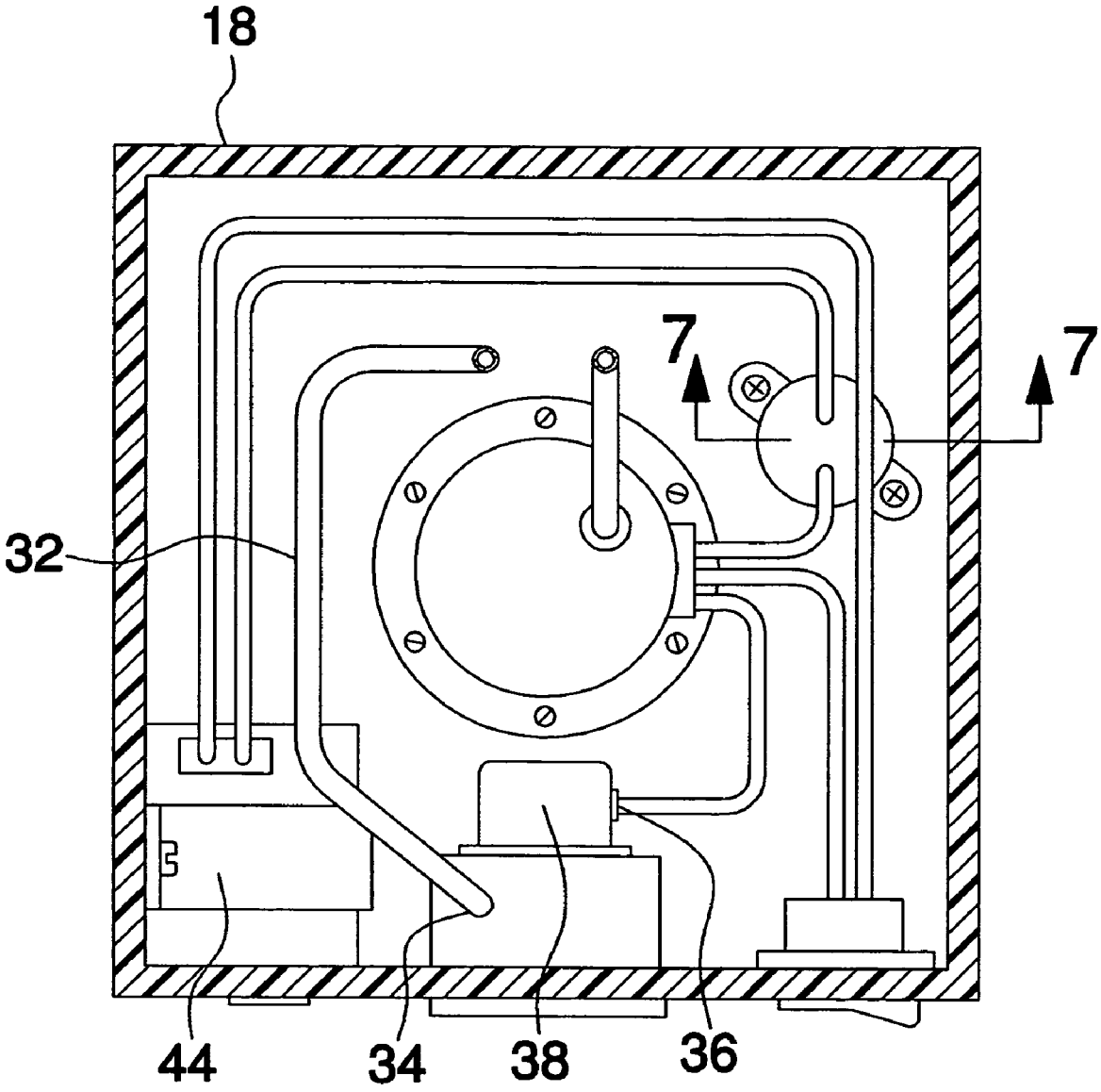
FIG. 4 is a cross-sectional view taken along line 4—4 of FIG. 2 of the present invention.
Figure 5:
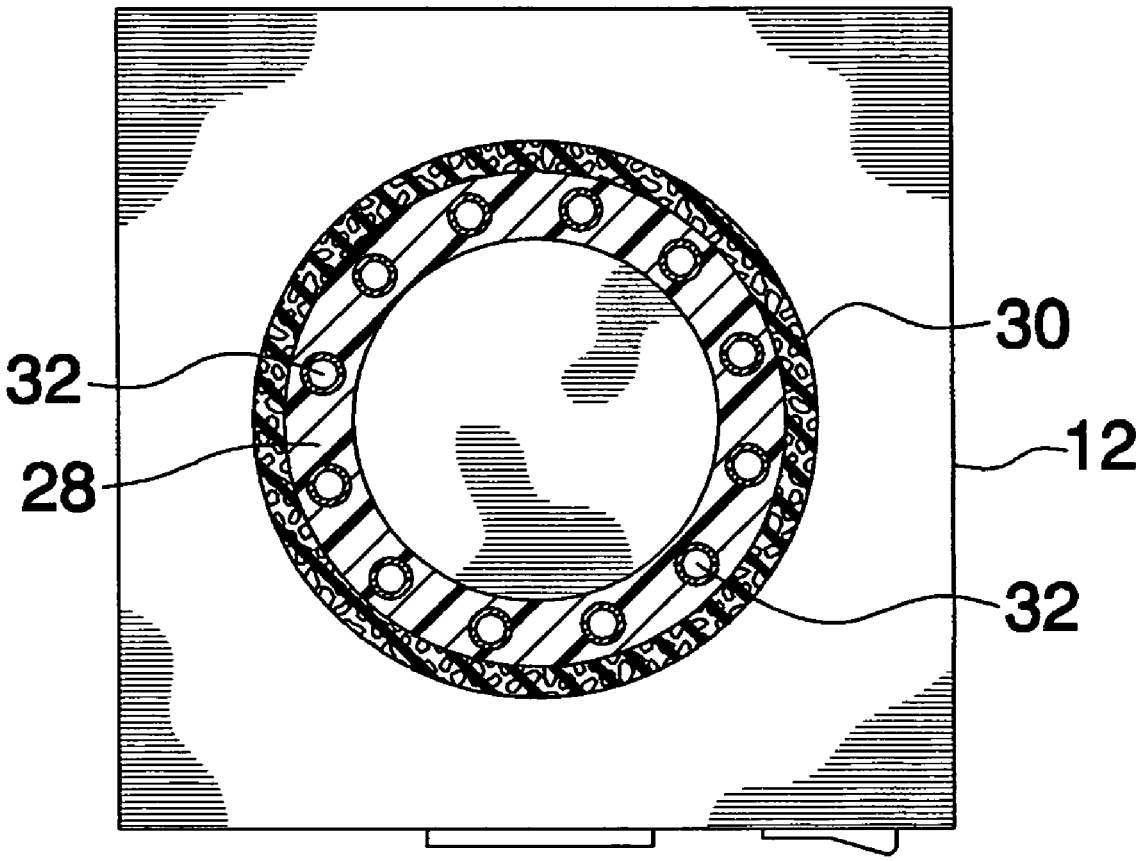
FIG. 5 is a cross-sectional view taken along line 5—5 of FIG. 2 of the present invention.
Figure 6:
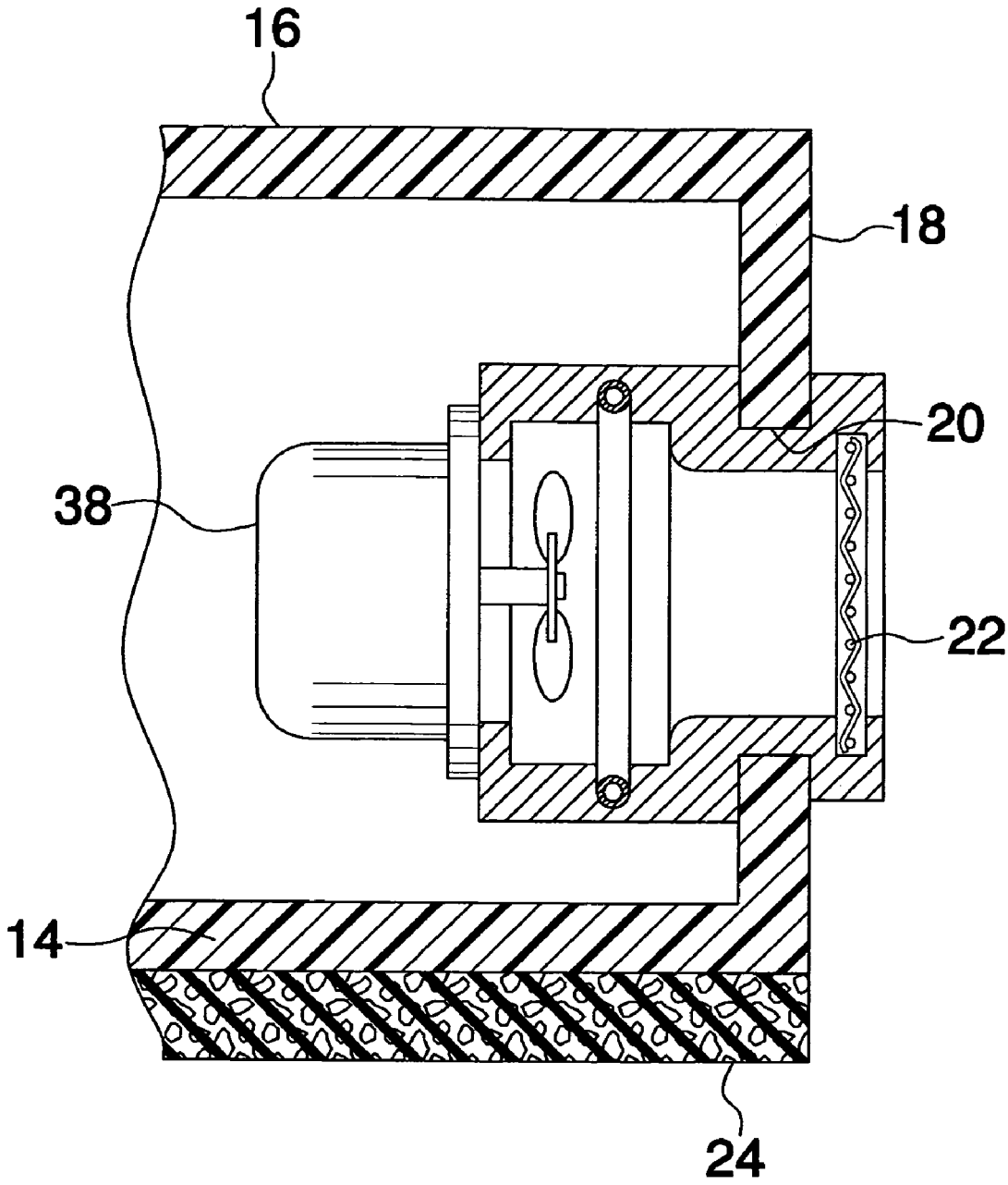
FIG. 6 is a cross-sectional view taken along line 6—6 of FIG. 2 of the present invention.
Figure 7:
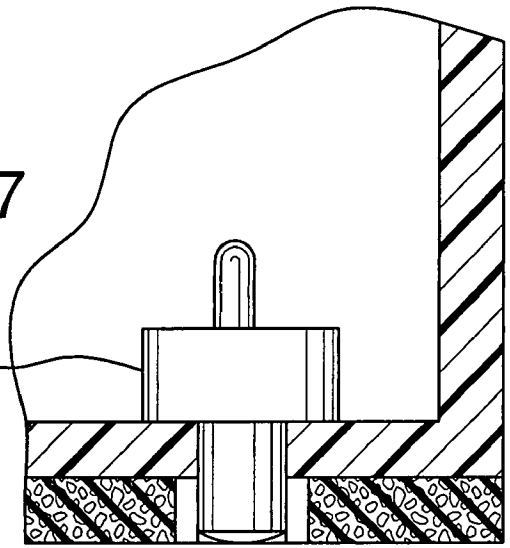
FIG. 7 is a cross-sectional view taken along line 7—7 of FIG. 4 of the present invention.
Figure 8:
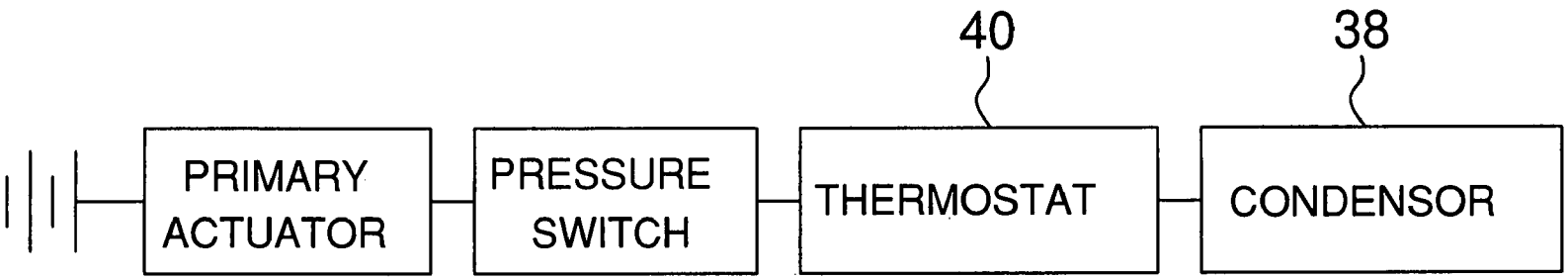
FIG. 8 is a schematic view of the present invention.

With reference now to the drawings, and in particular to FIGS. 1 through 8 thereof, a new beverage can cooling device embodying the principles and concepts of the present invention and generally designated by the reference numeral 10 will be described.

As best illustrated in FIGS. 1 through 8, the beverage can cooling apparatus 10 generally comprises a housing 12 that has a bottom wall 14, a top wall 16 and a peripheral wall 18, which is attached to and extends between the top 16 and bottom 14 walls. An opening 20 extends through the peripheral wall 18 and a screen 22 is positioned over the opening 20. The housing 12 has a width and length each equal to about 4 inches and a height less than 2 inches. A resiliently elastic material 24 is attached to and covers a bottom surface of the bottom wall 14.

A container 26 is formed by a cylindrical wall 28 that is attached to and extends upwardly from the top wall 16. The container 26 has an inner diameter equal to at least 2 9/16 inches. The cylindrical wall 28 has a height generally equal to about 5 inches. An insulated material 30 is positioned on and covering an outer surface of the peripheral wall.

A cooling assembly is mounted in the housing 12 and extends into the cylindrical wall 28. The cooling assembly includes a coolant coil 32 with first 34 and second 36 ends positioned between the top 16 and bottom 14 walls. The coolant coil 32 extends upwardly into the cylindrical wall 28. The coolant coil 32 is coiled throughout the cylindrical wall 28. The cooling assembly also includes a condenser 38 is mounted adjacent to the opening 20. The first 34 and second 36 ends of the coolant coil 32 are fluidly coupled to the condenser 38. The condenser 38 is adapted for circulating cooled fluid through the coolant coil 32. A thermostat 40 is electrically coupled to the condenser 32. The thermostat 40 is adapted for retaining the cooled fluid of the condenser at a temperature generally between 35° F. and 40° F. A power supply 41 is electrically coupled to the coolant assembly. Ideally, the power supply comprises a rechargeable battery 44 that is mounted in the housing 12. A power port 42 is mounted in the peripheral wall 28 and is electrically coupled to the rechargeable battery 44. A conventional wall outlet power plug or cigarette lighter plug 46 includes a female jack 48 for electrically coupling with the power port 42.

A primary actuator 50 is electrically coupled to the power supply 41 for selectively turning on or off the cooling assembly. The primary actuator 50 is mounted in the peripheral wall 18. A pressure switch 52 is electrically coupled to the power supply 41. The pressure switch 52 is mounted in the bottom wall 14 and extends downwardly away therefrom. The pressure switch 52 is adapted for detecting a weight greater than 2 ounces, the pressure switch 52 turning off the cooling assembly when a weight of less than 2 ounces is positioned on the top wall 16.

In use, the cooling assembly cools the cylindrical wall 28. The cylindrical wall 28 then cools a beverage can 8, which is removably positioned in the container 28. The pressure switch 52 ensures that the cooling assembly is turned off when the beverage can is not in the container or when the beverage can 8 is nearly empty.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cooling apparatus for cooling a beverage can, said apparatus comprising:

a housing having a bottom wall, a top wall and a peripheral wall being attached to and extending between said top and bottom walls, an opening extending through said peripheral wall;

a container being formed by a cylindrical wall being attached to and extending upwardly from said top wall;

a cooling assembly being mounted in said housing and extending into said cylindrical wall;

a power supply being electrically coupled to said cooling assembly;

a pressure switch being electrically coupled to said power supply, said pressure switch being mounted in said bottom wall and extending downwardly away therefrom, said pressure switch being adapted for detecting a weight greater than 2 ounces, said pressure switch turning off said cooling assembly when a weight of less than 2 ounces is positioned on said top wall; and wherein said cylindrical wall is cooled by said cooling assembly and wherein the beverage can can be removably positioned within said container such that the beverage can is cooled by the cylindrical wall.

2. The apparatus according to claim 1, wherein said container has an inner diameter equal to at least 2 9/16 inches, said cylindrical wall having a height generally equal to about 5 inches.

3. The apparatus according to claim 1, wherein said cooling assembly includes:

a coolant coil including first and second ends positioned between said top and bottom walls, said coolant coil extending upwardly into said cylindrical wall, said coolant coil being coiled throughout said cylindrical wall;

a condenser being mounted adjacent to an opening extending through said peripheral wall, said first and second ends of said coolant coil being fluidly coupled to said condenser, said condenser being adapted for circulating cooled fluid through said coolant coil;

a thermostat being electrically coupled to said condenser.

4. The apparatus according to claim 3, wherein said thermostat is adapted for retaining said cooled fluid at a temperature generally between 35° F. and 40° F.

5. The apparatus according to claim 1, wherein said power supply comprises a rechargeable battery mounted in said housing, a power port being mounted in said peripheral wall and being electrically coupled to said rechargeable battery.

6. The apparatus according to claim 3, further including a primary actuator being electrically coupled to said power supply for selectively turning on or off said cooling assembly, said primary actuator being mounted in said peripheral wall.

7. The apparatus according to claim 1, further including an insulated material being positioned on and covering an outer surface of said peripheral wall.

8. The apparatus according to claim 1, further including a resiliently elastic material being attached to and covering a bottom surface of said bottom wall.

9. The apparatus according to claim 4, further including an insulated material being positioned on and covering an outer surface of said peripheral wall.

10. The apparatus according to claim 4, further including a resiliently elastic material being attached to and covering a bottom surface of said bottom wall.

11. A cooling apparatus for cooling a beverage can, said apparatus comprising:

a housing having a bottom wall, a top wall and a peripheral wall being attached to and extending between said top and bottom walls, said peripheral wall having an opening extending therethrough, a screen being positioned over said opening, said housing having a width and length each equal to about 4 inches;

a container being formed by a cylindrical wall being attached to and extending upwardly from said top wall, said container having an inner diameter equal to at least 2 9/16 inches, said cylindrical wall having a height generally equal to about 5 inches;

a cooling assembly being mounted in said housing and extending into said cylindrical wall, said cooling assembly including;

a coolant coil including first and second ends positioned between said top and bottom walls, said coolant coil extending upwardly into said cylindrical wall, said coolant coil being coiled throughout said cylindrical wall;

a condenser being mounted adjacent to said opening, said first and second ends of said coolant coil being fluidly coupled to said condenser, said condenser being adapted for circulating cooled fluid through said coolant coil;

a thermostat being electrically coupled to said condenser, said thermostat being adapted for retaining said cooled fluid at a temperature generally between 35° F. and 40° F.;

a power supply being electrically coupled to said cooling assembly, said power supply comprising a rechargeable battery mounted in said housing, a power port being mounted in said peripheral wall and being electrically coupled to said rechargeable battery;

a primary actuator being electrically coupled to said power supply for selectively turning on or off said cooling assembly, said primary actuator being mounted in said peripheral wall;

a pressure switch being electrically coupled to said power supply, said pressure switch being mounted in said bottom wall and extending downwardly away therefrom, said pressure switch being adapted for detecting a weight greater than 2 ounces, said pressure switch turning off said cooling assembly when a weight of less than 2 ounces is positioned on said top wall;

an insulated material being positioned on and covering an outer surface of said peripheral wall;

a resiliently elastic material being attached to and covering a bottom surface of said bottom wall; and wherein said cylindrical wall is cooled by said cooling assembly and wherein the beverage can can be removably positioned within said container such that the beverage can is cooled by the cylindrical wall.

* * * * *